US012163341B2

(12) United States Patent
Reed et al.

(10) Patent No.: US 12,163,341 B2
(45) Date of Patent: Dec. 10, 2024

(54) CONCRETE TROWEL

(71) Applicant: MILWAUKEE ELECTRIC TOOL CORPORATION, Brookfield, WI (US)

(72) Inventors: Michael C. Reed, Milwaukee, WI (US); Travis S. Mergener, Horicon, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 10 days.

(21) Appl. No.: 17/691,339

(22) Filed: Mar. 10, 2022

(65) Prior Publication Data

US 2022/0290448 A1 Sep. 15, 2022

Related U.S. Application Data

(60) Provisional application No. 63/159,740, filed on Mar. 11, 2021.

(51) Int. Cl.
*E04F 21/24* (2006.01)
*E01C 19/42* (2006.01)

(52) U.S. Cl.
CPC ..... *E04F 21/248* (2013.01); *E01C 19/42* (2013.01)

(58) Field of Classification Search
CPC ..... E01C 19/42; E04F 21/245; E04F 21/247; E04F 21/248
USPC ..... 404/112
See application file for complete search history.

(56) References Cited

U.S. PATENT DOCUMENTS 2,882,806 A * 4/1959 Thieme ..... E04F 21/248 404/112
2,888,863 A * 6/1959 Eisenbeis ..... E04F 21/248 404/112
4,232,980 A * 11/1980 Tertinek ..... E04F 21/248 404/112
4,312,603 A 1/1982 Whiteman, Jr.
4,320,986 A * 3/1982 Morrison ..... E04F 21/248 404/112

(Continued)

FOREIGN PATENT DOCUMENTS

JP 3039124 U 7/1997
JP 2004225523 A 8/2004
WO 2013043117 A1 3/2013

OTHER PUBLICATIONS

BCRS Equipment, "Whiteman J36E2 Electric Power Trowel w/ Standard Handle," <https://www.borsequipment.com/whiteman-j36e2-electric-power-trowel-w-standard-handle.html> web page publicly available at least as early as Jan. 13, 2021.

(Continued)

*Primary Examiner* — Gary S Hartmann
(74) *Attorney, Agent, or Firm* — Michael Best & Friedrich LLP

(57) ABSTRACT

A concrete trowel includes a frame, a drive assembly including a motor mounted on the frame and a drive hub configured to receive torque from the motor, a handle assembly extending from the frame for controlling the concrete trowel, a rotor including a plurality of blades, the rotor rotatably coupled to the drive assembly for rotating about a rotational axis, and a steering control system mounted on the handle assembly to selectively adjust an orientation of the drive hub relative to a work surface in a plurality of different directions to adjust a pressure applied by the blades against the work surface.

12 Claims, 4 Drawing Sheets

(56) References Cited

U.S. PATENT DOCUMENTS

| | | | | |
|---|---|---|---|---|
| 4,614,463 | A | 9/1986 | Hughes | |
| 5,108,220 | A * | 4/1992 | Allen | E04F 21/247 404/112 |
| 5,372,452 | A * | 12/1994 | Hodgson | E04F 21/248 404/112 |
| 5,405,216 | A * | 4/1995 | Allen | E04F 21/248 404/112 |
| 5,613,801 | A * | 3/1997 | Allen | E04F 21/247 404/112 |
| 5,816,740 | A * | 10/1998 | Jaszkowiak | E04F 21/247 404/112 |
| 7,775,740 | B2 * | 8/2010 | Berritta | E04F 21/247 404/112 |
| 7,980,783 | B2 * | 7/2011 | Jaszkowiak | E04F 21/248 404/112 |
| 8,132,984 | B2 | 3/2012 | Grahl | |
| 9,068,301 | B2 * | 6/2015 | Fielder | E04F 21/247 |
| 2002/0150426 | A1 * | 10/2002 | Vandewinckel | E04F 21/248 404/112 |
| 2008/0289842 | A1 * | 11/2008 | Chapple | E04F 21/248 173/162.2 |
| 2013/0315667 | A1 | 11/2013 | Hanson et al. | |
| 2019/0006980 | A1 | 1/2019 | Sheeks et al. | |
| 2020/0263443 | A1 | 8/2020 | Del Real et al. | |

OTHER PUBLICATIONS

Bosch, "Cut Downtime with Just One Click," <https://xlock.boschtools.com/> web page publicly available at least as early as Jan. 13, 2021.

International Search Report and Written Opinion for Application No. PCT/US2022/019689 dated Jun. 16, 2022 (11 pages).

* cited by examiner

CONCRETE TROWEL

CROSS-REFERENCE TO RELATED APPLICATIONS

This application claims priority to U.S. Provisional Patent Application No. 63/159,740 filed on Mar. 11, 2021, the entire content of which is incorporated herein by reference.

FIELD OF THE INVENTION

The present invention relates to powered concrete trowels, and more particularly to powered concrete finishing trowels.

BACKGROUND OF THE INVENTION

Powered concrete trowels are typically used for finishing concrete surfaces and generally include a gas-powered motor mounted on a frame or "cage" that surrounds a rotor having a plurality of concrete trowel blades. The rotor is rotatably driven by the motor, which rotates the blades on a concrete surface. The trowel is controlled by an operator via a handle extending from the cage. Typically, to steer and control the movement of the trowel, a user selectively adjusts the pressure on the handle to direct the trowel to the left or the right. For example, the user could lift on the handle to bias the blade pressure forward which would help the trowel steer to the left, or push down on the handle to bias the blade pressure backward which would steer the trowel to the right. While effective, these repetitive movements on the handle can result in the user tiring quickly after long hours of use.

SUMMARY OF THE INVENTION

In an embodiment of the present invention, a concrete trowel is disclosed and includes a frame, a drive assembly including a motor mounted on the frame and a drive hub configured to receive torque from the motor, a handle assembly extending from the frame for controlling the concrete trowel, a rotor including a plurality of blades, the rotor rotatably coupled to the drive assembly for rotating about a rotational axis, and a steering control system mounted on the handle assembly to selectively adjust an orientation of the drive hub relative to a work surface in a plurality of different directions to adjust a pressure applied by the blades against the work surface.

In another embodiment of the present invention, a concrete trowel is disclosed and includes a frame, a handle assembly extending from the frame for controlling the concrete trowel, a plurality of rotors coupled to the frame, each of the rotors including a plurality of blades, a drive assembly mounted to the frame including a plurality of motors, mounted to the respective rotors, operable to provide torque to the rotors to rotate the rotors about respective rotational axes, and a steering control system mounted on the handle assembly configured to selectively adjust the torque provided to the rotors and/or a rotational direction of one or more of the rotors.

In yet another embodiment of the present invention, a concrete trowel is disclosed and includes a frame having a blade guard, a drive assembly including a motor mounted on the frame and a drive hub within the blade guard configured to receive torque from the motor, an actuator disposed on the frame between the blade guard and the drive hub, the actuator operable to tip the drive hub in a forward or rearward direction relative to the frame, a handle assembly extending from the frame for controlling the concrete trowel, a rotor including a plurality of blades, the rotor rotatably coupled to the drive assembly for rotating about a rotational axis, and a steering control system mounted on the handle assembly to selectively actuate the actuator to adjust an orientation of the drive hub relative to a work surface in a plurality of different directions to steer the concrete trowel along the work surface.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
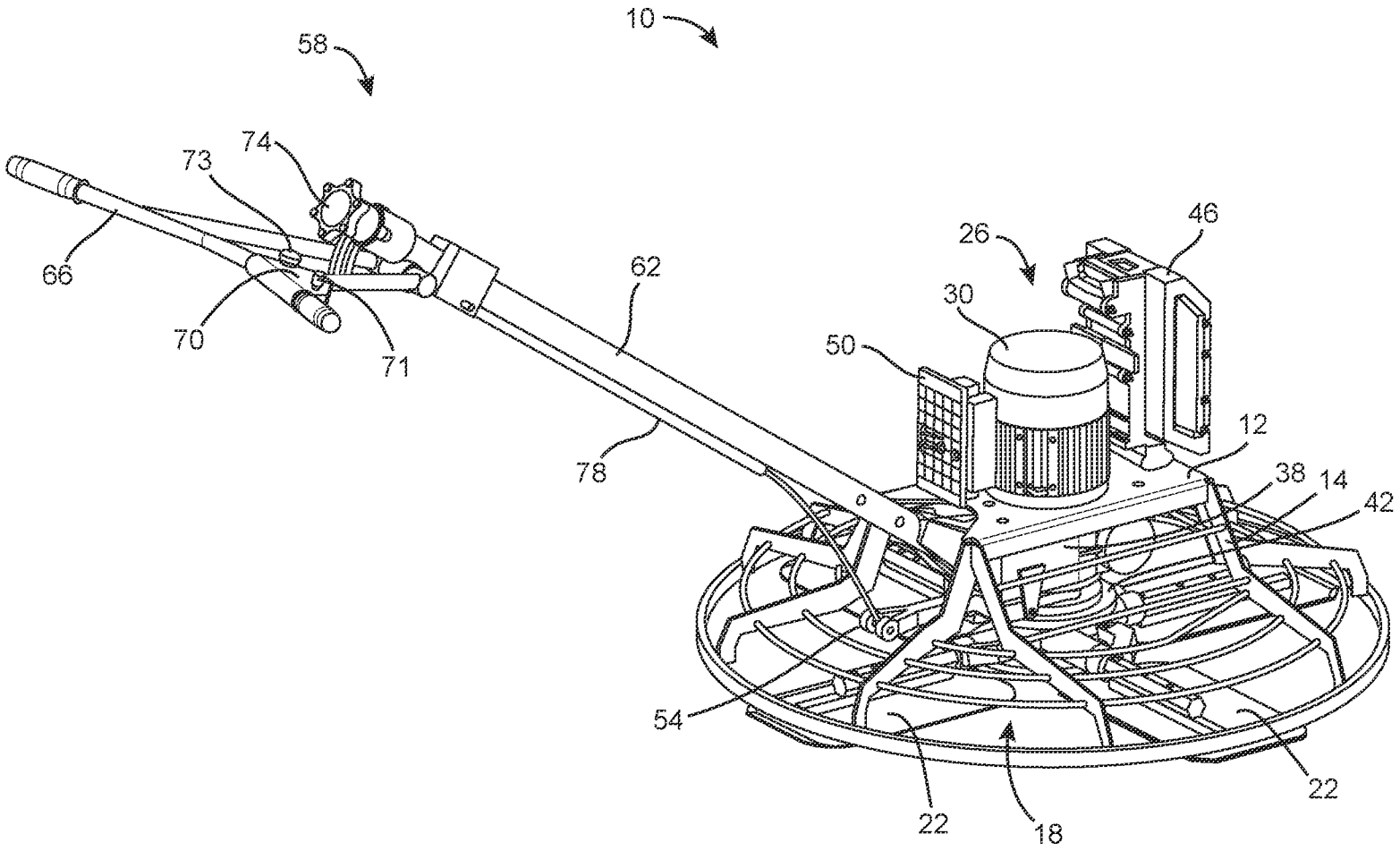
FIG. 1 is perspective view of a concrete trowel according to an embodiment of the invention.

FIG. 1 illustrates a concrete trowel 10 including a frame 12 having a blade guard 14 surrounding a rotor 18 having a plurality of blades 22, a drive assembly 26 mounted on the frame 12 having a motor 30 (e.g. a brushless direct current electric motor) with an output shaft 32 extending from the motor 30 (FIG. 2), and a gear box 38 coupled to the motor 30 having a drive hub 42. The drive assembly 26 is powered by a battery pack 46 supported by the frame 12 and in selective electrical communication with the motor 30 to provide electrical power to the motor 30. In some embodiments of the trowel 10, the battery pack 46 and the motor 30 can be configured as an 80 Volt high power battery pack 46 and motor 30, such as the 80 Volt battery pack and motor disclosed in U.S. patent application Ser. No. 16/025,491 filed on Jul. 2, 2018 (now U.S. Patent Application Publication No. 2019/0006980), the entirety of which is incorporated herein by reference. It is to be understood that the motor 30 may be a combustion engine and in such a case, in lieu of a battery pack 46, the concrete trowel 10 may include a fuel cell and a fuel injection system, or carburetion system, in fluid communication with the motor 30.

Figure 2:
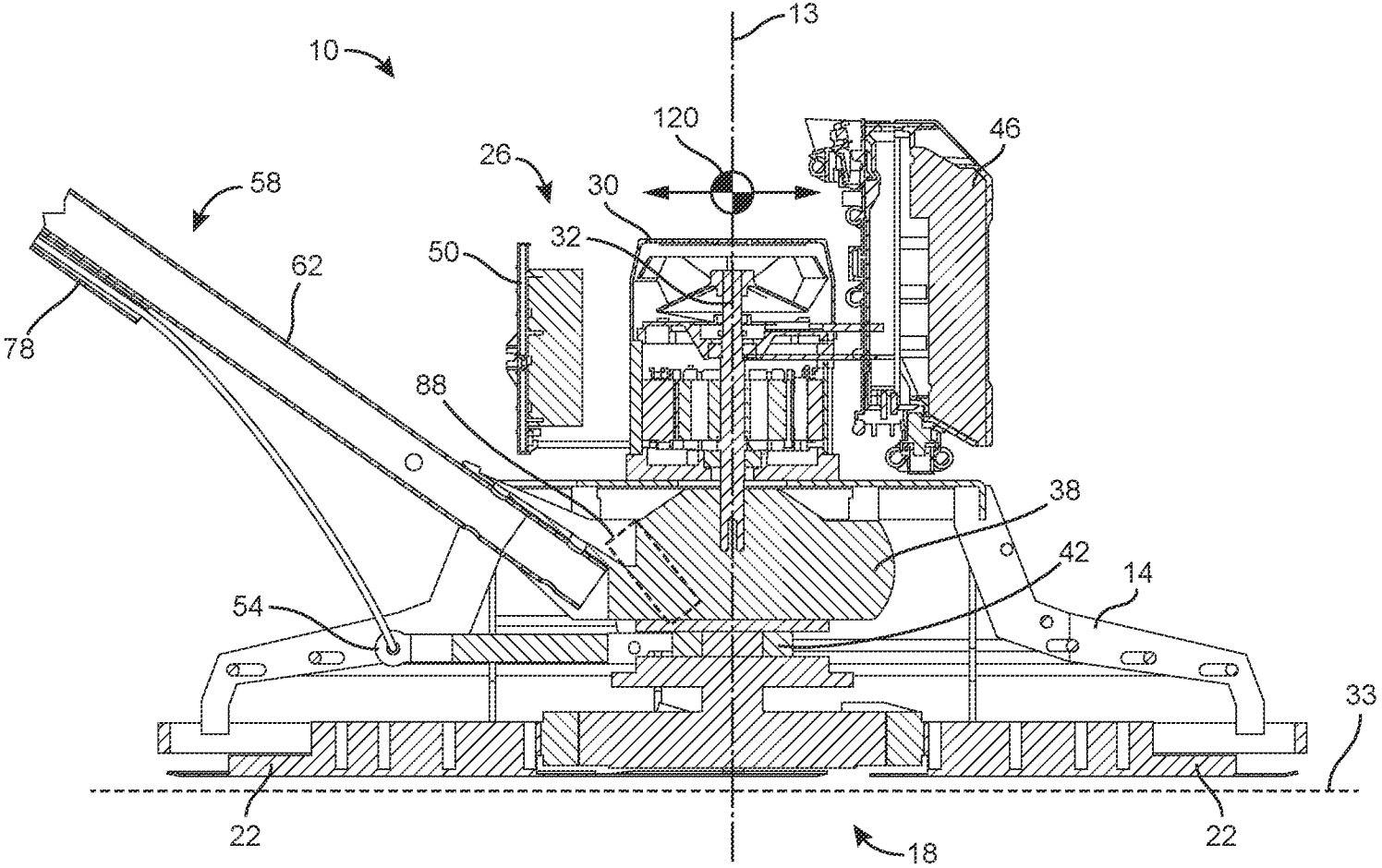
FIG. 2 is a side, partial cutaway view of the concrete trowel of FIG. 1.

With reference to FIGS. 1 and 2, the motor 30 is configured to supply torque to the gear box 38 via the output shaft 32, rotatably driving the drive hub 42 and rotor 18 to rotate the blades 22. The motor 30 is oriented on the frame 12 such that the output shaft 32 extends from the motor 30 in a direction perpendicular to a work surface 33. In some embodiments of the trowel 10, the drive assembly 26 can be a direct drive system where the output shaft 32 is coaxial with and directly connected to the drive hub 42 to rotatably drive the rotor 18, without the intervening gear box 38.

With reference to FIG. 2, the concrete trowel 10 further includes a controller 50 (including, amongst other components, a printed circuit board having one or more microprocessors and multiple filed-effect transducers for driving the motor 30), a blade adjustment yoke 54 pivotably coupled to the drive hub 42, and a handle assembly 58 including a post 62 extending obliquely from the frame 12 and handlebars 66 coupled to the post 62. The handle assembly 58 extends from the frame 12 and is used to control the concrete trowel 10. The handle assembly 58 further includes an operator control unit 70 mounted on one of the handlebars 66 having a plurality of operator controls (e.g., an ON/OFF switch 71, a speed adjustment switch 73, etc.) for providing an input signal to the controller 50, and a blade pitch adjustment knob 74 having an adjustment cable 78 coupled to the blade adjustment yoke 54. The blade pitch adjustment knob 74 is configured to selectively tension the adjustment cable 78, thereby pivoting the adjustment yoke 54 with respect to the drive hub 42, which adjusts the pitch of the blades 22 relative to the work surface 33.

In some embodiments of the trowel 10, the user can steer the trowel 10 left or right across the work surface 33 by selectively applying an upward or downward force to the handlebars 66. For example, if the user applies an upward force on the handlebars 66, the front of the blade guard 14 is tipped closer to the work surface 33, therefore increasing the pressure applied by the blades 22 to the work surface 33 forward of a rotational axis 13 of the rotor 18, which helps the trowel 10 steer to the left, or leftward. Likewise, if the user applies a downward force on the handlebars 66, the rear of the blade guard 14 is tipped closer to the work surface 33, therefore increasing the pressure applied by the blades 22 to the work surface 33 rearward of the rotational axis 13 of the rotor 18, which helps the trowel 10 steer to the right, or rightward.

Figure 3:
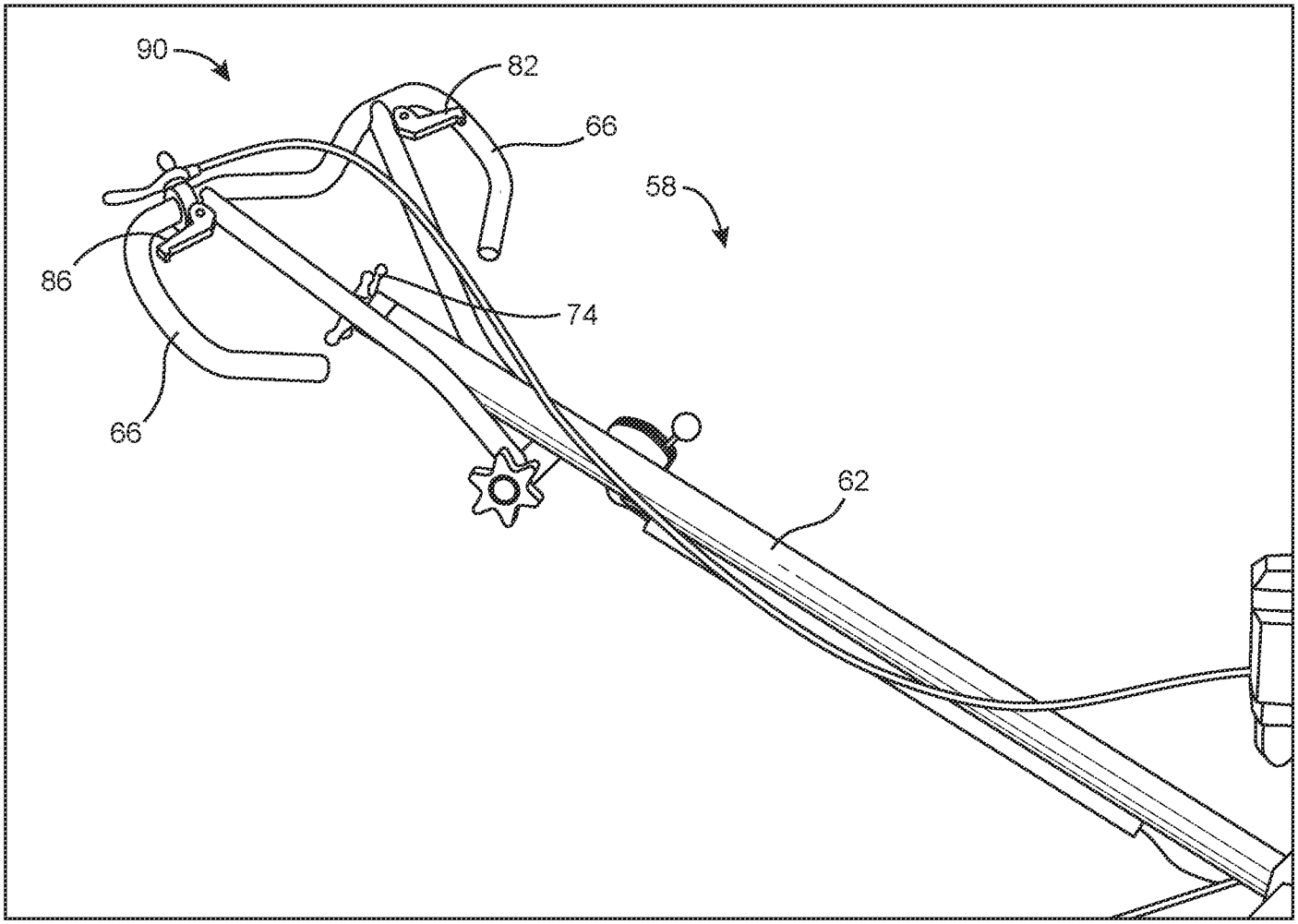
FIG. 3 a perspective view of a handle assembly for use with the concrete trowel of FIG. 1.

With reference to FIG. 3, in some embodiments of the concrete trowel 10, the handle assembly 58 includes a steering control system 90 having a left-hand lever 82 and a right-hand lever 86 mounted on respective handlebars 66. The left and right-hand levers 82, 86 are selectively actuated by the user to selectively communicate with an actuator 88 mounted, or otherwise disposed, on the frame 12, e.g., between the blade guard 14 and the drive hub 42, that selectively biases, or tips, the drive hub 42 in a forward or rearward direction, relative to the frame 12 and/or the blade guard 14, to increase the applied pressure by the blades 22 on the work surface 33, either forward or rearward of the rotational axis 13 of the rotor 18, which assists the user in turning the trowel 10 a specific direction. In a particular embodiment, the actuator 88 is a hydraulic cylinder that is extendable and retractable, or otherwise operable, in response to user inputs from the left and right-hand levers 82, 86 to bias the drive hub 42 in a first direction and a second direction to steer the concrete trowel 10. For example, when the user actuates the left-hand lever 82, the left-hand lever 82 moves the actuator 88 in a first direction to bias or tip the drive hub 42 and the blades 22 in a forward direction, thus applying a forward pressure on the blades 22, which steers the trowel 10 to the left, or leftward. Likewise, if the user actuates the right-hand lever 86, the right-hand lever 86 moves the actuator 88 in an opposite direction to bias or tip the drive hub 42 and the blades 22 in a rearward direction, thus applying a rearward pressure on the blades 22, which steers the trowel to the right, or rightward. Accordingly, the steering control system 90 is mounted on the handle assembly 58 to selectively actuate the actuator 88 to adjust an orientation of the drive hub 42 relative to the work surface 33 in a plurality of different directions to steer the concrete trowel 10 along the work surface 33.

In some embodiments of the concrete trowel 10, the left and right-hand levers 82, 86 interact with the actuator 88 using a wire, a hydraulic line, an electric signal from the operator control unit 70, or other conventional methods known by someone having ordinary skill in the art.

Figure 4A:
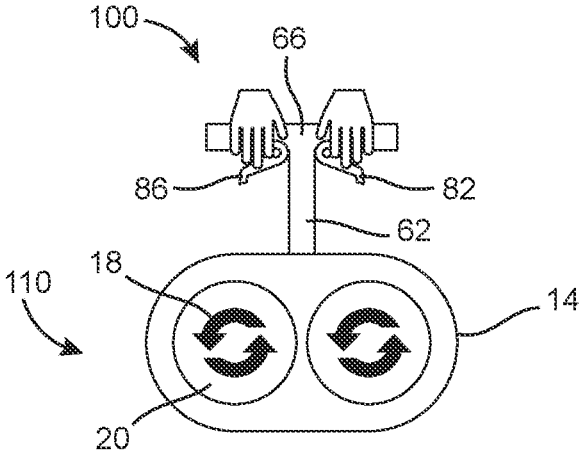
FIGS. 4A-4C are schematic views of a concrete trowel according to other embodiments of the invention.
Figure 4B:
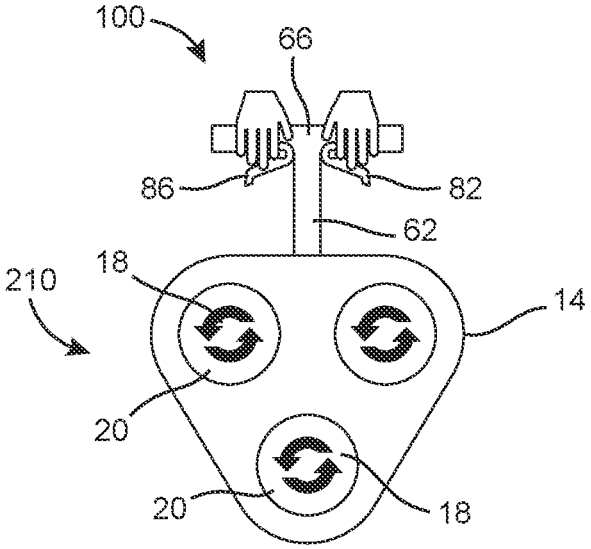
Figure 4C:
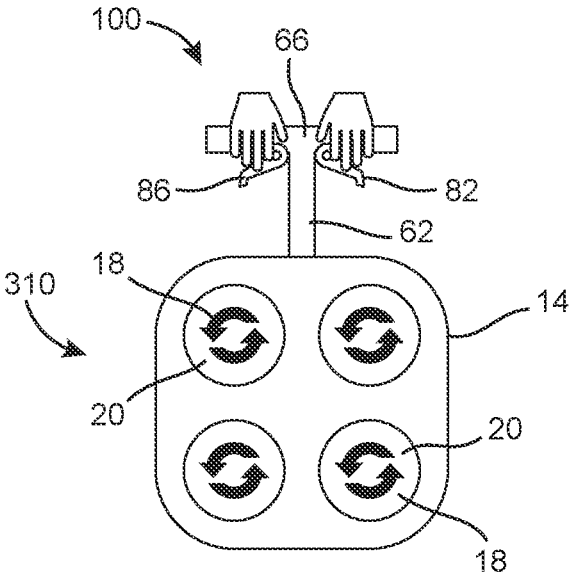

FIGS. 4A-4C illustrate other embodiment of the concrete trowel 110, 210, 310. Like components and features of the concrete trowel 10 of FIGS. 1 and 2 will be shown with like reference numbers. The concrete trowel 110 includes multiple rotors 18 (e.g., 2, 3, or 4, etc.) each having their own blades 22 that are selectively powered by individual motors 20 (e.g. a direct current brushless motor). In each of the different configurations of rotors 18, the rotors 18 are surrounded by the blade guard 14 and configured to be selectively controlled by a steering control system 100. The steering system 100 includes the left and right-hand levers 82, 86 mounted on respective handlebars 66 and configured to electrically communicate with each the individual motors 20 to selectively provide torque to all or a select one or group of individual rotors 18. To steer the trowel 10 left or right, the user can selectively actuate one of the levers 82, 86 which can selectively deactivate or reduce the rotational speed of one of the individual motors 20 to reduce the rotational speed of one of the rotors 18, thereby changing the speed of the respective blades 22 of the selected rotor 18. By changing the speed of one of the rotors 18, the user can alter the angular momentum of the trowel 110 causing it to predictably move in a desired direction. In some embodiments of the trowel 110, the levers 82, 86 can be configured to alter the rotational direction (i.e., clockwise or counterclockwise) of one or more of the rotors 18 to allow the trowel 110 to predictably turn a specific direction. In other embodiments of the trowel 110, the steering system 100 can simultaneously be used to alter an overall traveling speed of the trowel 110 (along the work surface 33) by selectively actuating different rotors 18.

In other embodiments of the trowel 110, the multiple rotors 18 can be controlled by a single motor 30 (e.g., a direct current brushless motor) configured to simultaneously drive each of the rotors 18 and control the rotational speed of each of the rotors 18 using a differential (e.g., a mechanical or electrical clutch, or other functionally equivalent differential-like mechanisms). In other embodiments, the steering system 100 can be adapted for use on a riding trowel system.

In some of the embodiments of the concrete trowels 10, 110, 210, 310 the trowels 10, 110, 210, 310 include a steering mechanism 120 (FIG. 2) having an adjustable counterweight system for altering the center of gravity of the trowel. By altering the center of gravity, the trowel will be selectively biased or tipped forward or rearward, which adjusts the relative pressure applied by the rotor 18 and blades 22 against the work surface 33 to predictably change the direction of travel of the trowel. In some embodiments of the trowels 10, 110, 210, 310 the adjustable counterweight system can include an axially moving cylinder having a movable mass (i.e., a counterweight), a rack and pinion having a movable mass, and a lead screw having a movable mass.

In other embodiments, the trowels 10, 110, 210, 310 can be remotely controlled or fully automated by the user via a remote controller (not shown) configured to communicate with the controller 50 to maneuver the trowels 10, 110, 210, 310 via the steering control systems 90, 100, 120.

By having the steering control systems 90, 100, 120 for assisting the user in steering the trowels 10, 110, 210, 310 during operation, the user doesn't have to repeatedly apply manual forces to the handle assembly 58 to guide the trowel a specific direction. Additionally, in some embodiments of the steering control system 100, the system 100 can propel the trowel in a particular direction, which provides the user with a certain degree of convenience allowing them to focus on finishing the work surface rather than directing the trowel. This added functionality of the control system 100 further allows the user to expend less effort on moving/steering the trowel, which increases the user's mobility and allows the user to complete the job not only more accurately, but also more timely.

Although the invention has been described in detail with reference to certain preferred embodiments, variations and modifications exist within the scope and spirit of one or more independent aspects of the invention as described.

Various features of the invention are set forth in the following claims.

What is claimed is:

1. A concrete trowel comprising:

a frame;

a drive assembly including a motor mounted on the frame and a drive hub configured to receive torque from the motor;

a handle assembly extending from the frame for controlling the concrete trowel, wherein the handle assembly includes a post extending obliquely from the frame and handlebars coupled to the post, wherein the post is fixed to the frame;

a rotor including a plurality of blades, the rotor rotatably coupled to the drive assembly for rotating about a rotational axis; and a steering control system mounted on the handle assembly to selectively adjust an orientation of the drive hub relative to a work surface in a plurality of different directions to adjust a pressure applied by the blades against the work surface to steer the concrete trowel along the work surface.

2. The concrete trowel of claim 1, wherein the plurality of different directions includes a forward direction and a rearward direction, and wherein the steering control system further comprises:

a left-hand lever for biasing the drive hub and the blades in the forward direction to move the concrete trowel leftward; and a right-hand lever for biasing the drive hub and the blades in a rearward direction to move the concrete trowel rightward.

3. The concrete trowel of claim 2, wherein the left-hand lever and the right-hand lever bias the drive hub and the blades in the forward or rearward direction by actuating an actuator mounted on the frame.

4. The concrete trowel of claim 3, wherein the actuator is selectively actuated by a wire, a hydraulic line, or an electrical signal from an operator control unit mounted on the handle assembly.

5. The concrete trowel of claim 3, wherein the actuator is a hydraulic cylinder operable to bias the drive hub in a first direction and a second direction to steer the concrete trowel.

6. The concrete trowel of claim 1, wherein the motor is an electric motor, and wherein the concrete trowel further comprises a battery pack supported on the frame for supplying electrical power to the motor.

7. A concrete trowel comprising:

a frame having a blade guard;

a drive assembly including a motor mounted on the frame and a drive hub within the blade guard configured to receive torque from the motor;

an actuator disposed on the frame between the blade guard and the drive hub, the actuator operable to tip the drive hub in a forward or rearward direction relative to the frame;

a handle assembly extending from the frame for controlling the concrete trowel, wherein the handle assembly includes a post extending obliquely from the frame and handlebars coupled to the post, wherein the post is fixed to the frame;

a rotor including a plurality of blades, the rotor rotatably coupled to the drive assembly for rotating about a rotational axis; and a steering control system mounted on the handle assembly to selectively actuate the actuator to adjust an orientation of the drive hub relative to a work surface in a plurality of different directions to steer the concrete trowel along the work surface.

8. The concrete trowel of claim 7, wherein the steering control system further comprises a left-hand lever for biasing the drive hub in the forward direction to move the concrete trowel leftward.

9. The concrete trowel of claim 8, wherein the steering control system further comprises a right-hand lever for biasing the drive hub and the blades in a rearward direction to move the concrete trowel rightward.

10. The concrete trowel of claim 7, wherein the actuator is selectively actuated by a wire, a hydraulic line, or an electrical signal from an operator control unit mounted on the handle assembly.

11. The concrete trowel of claim 7, wherein the motor is an electric motor, and wherein the concrete trowel further comprises a battery pack supported on the frame for supplying electrical power to the motor.

12. The concrete trowel of claim 7, wherein the actuator is a hydraulic cylinder operable to tip the drive hub in the forward direction or the rearward direction.

* * * * *